US009552945B2

(12) United States Patent
Britz

(10) Patent No.: US 9,552,945 B2
(45) Date of Patent: Jan. 24, 2017

(54) DIRECT CURRENT SWITCH WITH A DEVICE FOR ARC EXTINCTION INDEPENDENT OF CURRENT DIRECTION

(71) Applicant: EATON ELECTRICAL IP GMBH & CO. KG, Schoenefeld (DE)

(72) Inventor: Axel Britz, Koblenz (DE)

(73) Assignee: EATON ELECTRICAL IP GMBH & CO. KG, Schoenefeld (DE)

( * ) Notice: Subject to any disclaimer, the term of this patent is extended or adjusted under 35 U.S.C. 154(b) by 0 days.

(21) Appl. No.: 14/430,555

(22) PCT Filed: Sep. 25, 2013

(86) PCT No.: PCT/EP2013/070002
§ 371 (c)(1),
(2) Date: Mar. 24, 2015

(87) PCT Pub. No.: WO2014/049011
PCT Pub. Date: Apr. 3, 2014

(65) Prior Publication Data

US 2015/0243458 A1 Aug. 27, 2015

(30) Foreign Application Priority Data

Sep. 27, 2012 (DE) ..... 10 2012 109 195

(51) Int. Cl.
*H01H 33/18* (2006.01)
*H01H 9/44* (2006.01)
*H01H 1/20* (2006.01)

(52) U.S. Cl.
CPC ..... *H01H 33/182* (2013.01); *H01H 1/2058* (2013.01); *H01H 9/443* (2013.01)

(58) Field of Classification Search
CPC ..... H01H 1/2058; H01H 9/443; H01H 33/18; H01H 33/182; H01H 33/596; H01H 71/24; H01H 77/10; H01H 9/40; H01H 9/44
(Continued)

(56) References Cited

U.S. PATENT DOCUMENTS 2,922,926 A * 1/1960 Fehling ..... H01H 9/44 218/22
4,803,319 A 2/1989 Bernard et al.
(Continued)

FOREIGN PATENT DOCUMENTS

DE 1140998 B 12/1962
DE WO0133595 A1 * 5/2001 ..... H01H 71/02
(Continued)

OTHER PUBLICATIONS

Document attached (orig. published May 10, 2001).*

*Primary Examiner* — Renee S Luebke
*Assistant Examiner* — William Bolton
(74) *Attorney, Agent, or Firm* — Leydig, Voit & Mayer, Ltd.

(57) ABSTRACT

A direct current switch with a device for arc extinction independent of current direction includes at least two interconnected switch units, each switch unit having at least one current path having an interruption surface and having at least two switch contact elements for forming the interruption surface. An arc extinction device is associated with one or a plurality of current paths of the switch units. Devices for magnetic field generation are included, each generated magnetic field being assigned to different switch units' interruption surface and oriented such that its field lines run transversally to the respective interruption surface. Given a current flow direction, deflection forces of at least two generated magnetic fields act through flow paths contrary to
(Continued)

arcs extending longitudinally to respective interruption surface such that an arc is deflected towards the arc extinction device and a further arc is deflected away from the arc extinction device.

15 Claims, 4 Drawing Sheets

(58) Field of Classification Search
USPC ..... 218/22–26, 113; 335/201
See application file for complete search history.

(56) References Cited

U.S. PATENT DOCUMENTS

| | | | | |
|---|---|---|---|---|
| 6,259,338 | B1 * | 7/2001 | Boeder | H01H 1/2041 335/6 |
| 6,480,080 | B1 * | 11/2002 | Asada | H01H 1/2058 335/6 |
| 2008/0030289 | A1 * | 2/2008 | Kralik | H01H 9/34 335/201 |
| 2009/0127229 | A1 | 5/2009 | Schmitz et al. | |
| 2010/0126966 | A1 | 5/2010 | Domejean et al. | |
| 2013/0264310 | A1 | 10/2013 | Lang et al. | |

FOREIGN PATENT DOCUMENTS

| | | | |
|---|---|---|---|
| EP | 2061053 | A2 | 5/2009 |
| WO | WO 0229842 | A1 | 4/2002 |
| WO | WO 2012076606 | A1 | 6/2012 |

* cited by examiner

DIRECT CURRENT SWITCH WITH A DEVICE FOR ARC EXTINCTION INDEPENDENT OF CURRENT DIRECTION

CROSS-REFERENCE TO RELATED APPLICATIONS

This application is a U.S. national stage application under 35 U.S.C. §371 of International Application No. PCT/EP2013/070002, filed on Sep. 25, 2013, and claims benefit to German Patent Application No. DE 10 2012 109 195.1, filed on Sep. 27, 2012. The International Application was published in German on Apr. 3, 2014, as WO 2014/049011 A1 under PCT Article 21(2).

FIELD

The invention relates to a direct current switch with a device for arc extinction independent of current direction.

BACKGROUND

A known principle for extinguishing arcs in switch disconnectors and circuit breakers for alternating currents consists in forcing an arc with the aid of its own magnetic field into an extinction chamber provided specifically for this purpose, where it is split into a plurality of small arcs and cooled by the arrangement of extinction plates. This cooling causes a rise in voltage, which ultimately leads to the current being disconnected. The natural zero crossing of the current is also helpful here in the case of an applied alternating voltage source.

The extinction of arcs in the case of direct current switches is substantially more problematic in contrast since, especially in the case of high direct current voltages of up to 1500 volts, for example, and currents which are low relative to the nominal current (and which are dependent on the existing switch geometry), for example roughly 5 . . . 50 A, only a small magnetic field of the arc itself prevails, which is not normally sufficient to force the arc into an extinction chamber. A further problem is that no natural zero crossing exists in the case of direct currents, which makes the extinction of arcs even more difficult.

In an extreme case therefore when a direct current is switched, an arc between the open contacts of a switch can remain, not be extinguished and under certain circumstances destroy the switch, especially damage the switch contacts. Other standard protective devices such as circuit breakers likewise do not lead to the current being disconnected, since this is normally below the nominal current, i.e. there is an operating current for these protective devices which prevents disconnection.

EP 2 061 053 A2 discloses using the housing of a switching device for alternating current applications in the manufacture of a switching device for direct current applications and adapting this housing at low cost for direct current applications by adding a permanent magnet arranged in particular on the outside of the housing. As a result of this, the direct current switching capability of conventional alternating current switching devices is substantially increased since arcs are moved away from contact points of the switching device into extinction chambers by the permanent magnet field. It is also regarded as an advantage of the disclosure of EP 2 061 053 A2 that not every splitting surface and every extinction device needs to be assigned to one individual magnet each as is the case with known direct current switching devices.

W02012/076606A1 discloses a switch which is suitable for multipolar direct current operation independent of polarity and has at least two switching chambers. Each of the switching chambers has two extinction chambers with extinction plates to extinguish arcs occurring in the respective switching chamber between contact regions. Two magnets generate a magnetic field in the region of the switching contacts of all the switching chambers such that arcs are forced towards one of the extinction chambers of the switching chambers irrespective of the current direction in the arc. This switch exhibits rapid, reliable extinction behavior that is independent of the current direction and therefore prevents installation faults caused by polarity and is suitable for applications where switches are needed for both current directions.

SUMMARY

An aspect of the invention provides a direct current switch including a device configured for arc extinction independent of current direction. The direct current switch includes: at least two interconnected switch units, wherein each switch unit has a current path, the current path including an interruption surface, and the current path including at least two switch contact elements configured to form the interruption surface. An arc extinction device is associated with one or more current paths of the switch units. A magnetic field generation device is configured to generate one or more magnetic fields, each generated magnetic field being assigned to an interruption surface of a different switch unit of the switch units. The electromagnetic device is oriented such that its field lines run substantially transversely to the respective interruption surface. At a predetermined direction of current flow, deflection forces of at least two generated magnetic fields act through current paths counter to arcs extending in a longitudinal direction of the respective interruption surface such that at least one arc is deflected towards the arc extinction device and a further arc is deflected away from the arc extinction device. The switch units are rotatory double interrupters. The arc deflected away from the arc extinction device is directed onto a selector shaft or a selector shaft segment of a double interrupter.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
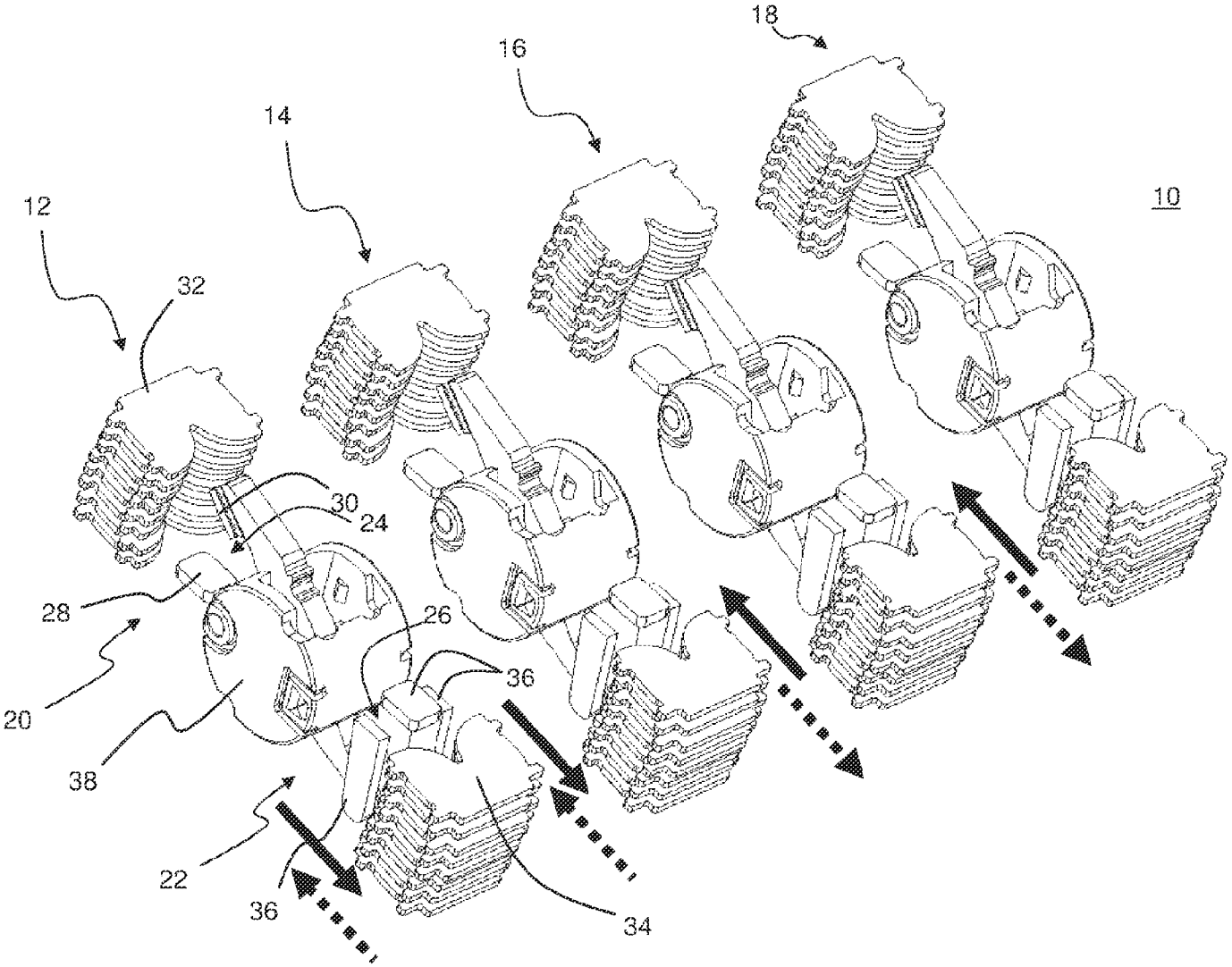
FIG. 1 shows an embodiment of a switch disconnector for direct current according to the invention with four switch units and four devices for magnetic field generation.

An aspect of the present invention provides an improved direct current switch.

One concept underlying the present invention is to provide differently orientated magnetic fields in a direct current switch with a plurality of switch units to deflect arcs arising during splitting. As a result, a deflection into extinction devices for extinguishing arcs can always be brought about independently of the current direction of the direct current to be switched. The arrangement of the devices for magnetic field generation to deflect arcs into extinction devices can be selected according to the invention such that by means of generated magnetic fields arcs at some switch units are deflected into extinction devices and arcs at other switch units are deflected counter to this, for example against a selector shaft of a direct current switch. The deflection of arcs, for example against rotary double interrupter selector shafts made from a duroplast for example, of rotatory double interrupters used as switching devices can cause an extension and simultaneous cooling of the arc without the surrounding components being destroyed. Therefore the principle according to the invention of orientating magnetic fields to deflect arcs in switch units of a direct current switch can lead to the required increase in voltage for splitting the direct current and breaking down arcs and thus also contribute to the splitting of small and critical currents in the case of high voltages which can, for example, occur in the cases described at the beginning. In particular, if a leakage current occurs, for example when a direct current switch is used in a photovoltaic plant and its current direction is opposite to the operating current, arcs that occur can nevertheless be reliably extinguished by the present invention since they are extinguished according to the invention independently of the current direction through a direct current switch.

In principle, the arrangement and orientation of magnetic fields to deflect arcs can be distributed in any given manner according to the invention. Distribution that is as even as possible is advantageous so that in the event of reversible directions of current flow, roughly similar extinction conditions exist and the switch can safely disconnect the current flow irrespectively of polarity. The invention is especially suitable for using switching devices for alternating current applications to switch direct currents by modifying them with little technical effort.

One embodiment of the invention relates to a direct current switch with a device for arc extinction independent of current direction, comprising at least two interconnected switch units, each switch unit having at least one current path, which has an interruption surface, and each current path having at least two switch contact elements for forming the interruption surface, at least one arc extinction device, which is associated with one or more current paths of the switch units, and one or more devices for magnetic field generation, each generated magnetic field being assigned to an interruption surface of different switch units and being orientated such that its field lines run substantially transversely to the respective interruption surface and, at a predetermined direction of current flow, the deflection forces of at least two generated magnetic fields acting through the current paths counter to the arcs that extend in the longitudinal direction of the respective interruption surface such that at least one arc is deflected towards the arc extinction device and a further arc is deflected away from the arc extinction device. The devices for magnetic field generation can, for example, comprise electromagnets, permanent magnets and/or inductors.

The switch units can be rotatory double interrupters, and an arc deflected away from the arc extinction device can be directed onto the selector shaft or a selector shaft segment of a double interrupter. The selector shaft or selector shaft segment can serve here to cool an arc directed onto it such that it breaks down or extinguishes. A rotatory double interrupter comprises two interruption surfaces and the four switch contact elements are each separated by one rotation in that, for example, two switch contact elements are coupled to the selector shaft and are thus movably mounted and two further switch contact elements are fixed.

Each switch unit can comprise at least one device for magnetic field generation. As a result of this, an individual magnetic field can be generated for each switch unit, as a result of which the direction in which an arc that occurs is deflected can be determined by the at least one current path of a switch unit, for example by the appropriate adjustment of the magnetic field, independently of the specified direction of current flow.

Furthermore, it can be provided for the deflection forces of the magnetic fields generated by the devices for magnetic field generation to act on arcs that extend in the longitudinal direction of the respective interruption surface in the case of about half of the switch units such that, at the predetermined direction of flow through the current paths, the arcs are deflected towards the arc extinction device and in the case of the remaining switch units, the deflection forces of the magnetic fields generated by the devices for magnetic field generation act on arcs extending in the longitudinal direction of the respective interruption surfaces such that, at the predetermined direction of flow through the current paths, the arcs are deflected towards parts of the switching devices which facilitate extinction of the arcs.

The parts of the switching devices, for example selector shaft segments or housing parts of the switching devices, can consist of a material which causes cooling of the arc, in particular consist of a duroplast. It has been shown that a duroplast is particularly suitable for cooling arcs without the duroplast incurring damage from the arcs.

If the devices for magnetic field generation comprise permanent magnets, this has the advantage that no separate supply of electrical energy is required for generating a magnetic field. Moreover, implementation with permanent magnets requires less maintenance in comparison, for example, to electromagnets or inductors and is less prone to malfunctions.

The direct current switch can be a four-phase alternating current switch, which has been configured to switch direct current by appropriate interconnection of the individual switch units.

Further advantages and possible applications of the present invention will emerge from the description hereinafter in conjunction with the embodiments shown in the drawings.

In the following description identical, functionally identical and functionally cohesive elements may be provided with the same reference numerals. Absolute values are only given by way of example hereinafter and shall not be understood to limit the invention.

The switch disconnector 10 shown in FIG. 1 provided per se for switching a four-phase alternating current comprises four switch units 12, 14, 16, 18, which are principally identical in structure, for each phase N, L1, L2 and L3. The switch units 12, 14, 16, 18 used are rotatory double interrupters each with two current paths and two interruption surfaces, which are connected to one another in series, in order to achieve the required high total arc voltage and thus to counteract a driving supply voltage applied externally and to extinguish the current as rapidly as possible.

Because of the serial interconnection of the double interrupter, the direction of current flow through the current paths is specified the same for each of the double interrupters. By way of example, in the case of the rotatory double interrupter 12 in FIG. 1, the two current paths are denoted by the reference numerals 20 and 22 and the two interruption surfaces by the reference numerals 24 and 26.

Moreover, each double interrupter 12, 14, 16 and 18 comprises a duroplast selector shaft segment 38, which is coupled to a selector shaft (not shown) and rotates therewith, in order to disconnect or connect the contacts 28, 30 and 29, 31 of the interruption surfaces 24 and 26.

Figure 2:
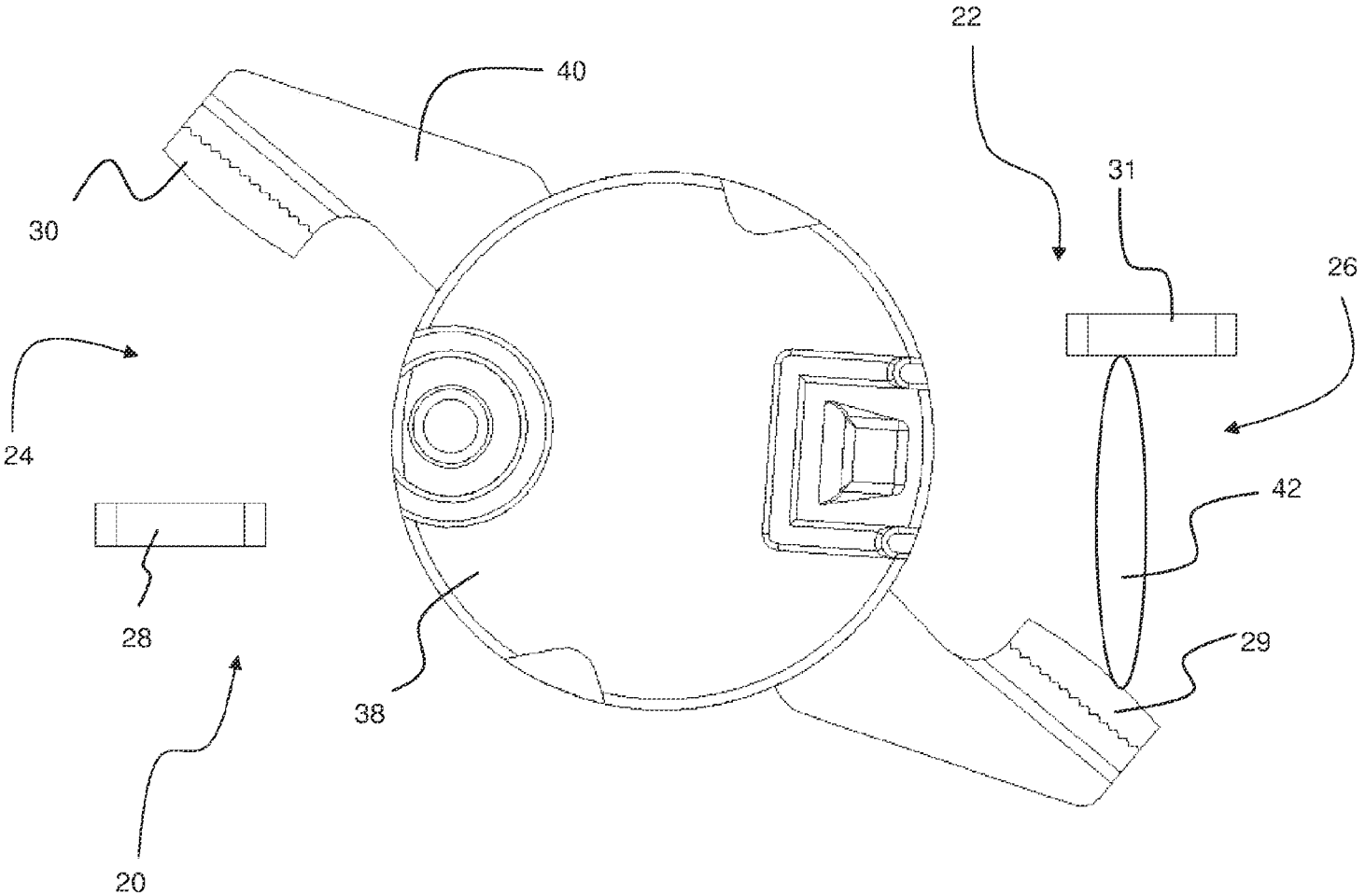
FIG. 2 is a side view of a switch unit of the switch disconnector from FIG. 1 without a device for magnetic field generation and an arc between switching contacts of the unit.

FIG. 2 is a side view of a double interrupter. It can be seen here that the first current path 20 comprises a first interruption surface 24 with a lower fixed contact 28 and a contact piece with an upper movable contact 30. The contact piece with the upper movable contact 30 is coupled to the selector shaft segment 38 by means of a switching contact arm 40 and can be moved by rotating the segment 38 such that the interruption surface 24 can be opened or closed. The second current path 22 accordingly comprises a second interruption surface 26 with an upper fixed contact 31 and a contact piece with a lower movable contact 29, which likewise is coupled to the segment 38 by means of the switching contact arm 40. The movable contacts 29 and 30 are therefore moved synchronously by means of the selector shaft segment 38 such that the two interruption surfaces 24 and 26 are synchronously opened and closed.

In order to extinguish arcs, extinction chambers each formed by bundles of arc extinction plates 32 and 34 respectively are arranged in the region of the interruption surfaces 24 and 26 respectively in the case of each of the four double interrupters 12, 14, 16 and 18. The bundles of arc extinction plates 32 and 34 respectively are arranged here such that they extinguish arcs which are deflected in a predetermined direction away from the duroplast selector shaft segment 38 into the extinction plates 32 and 34 respectively.

In the case of the double interrupter shown in a side view in FIG. 2, an arc 42 that has not been deflected by a magnetic field is shown between the two contacts 29 and 31.

In order to deflect the arcs, each double interrupter 12, 14, 16 and 18 comprises a respective arrangement of permanent magnets 36 about at least one of its interruption surfaces 24 and 26 (in FIG. 1 arrangements of permanent magnets 36 are only shown about the second interruption surface 26 although permanent magnets could also be arranged about the first interruption surface 24). The arrangement of permanent magnets 36 generates a magnetic field in the region of the surrounded interruption surface 26, the field lines of which run substantially transversely to the surrounded interruption surface 26. Furthermore, the magnetic fields of the permanent magnet arrangements are polarized such that, at a predetermined direction of current flow (direction of operating current flow) through the current paths 20 and 22 they generate deflection forces which act on arcs and deflect the arcs in a predetermined direction, typically either towards the bundles of arc extinction plates 34 or to the duroplast-selector shaft segments 38. According to the invention, at least two of the generated magnetic fields are polarized such that when the current is flowing in the operating direction, an arc occurring at one interruption surface is deflected towards the bundles of arc extinction plates 34 and an arc occurring at another interruption surface is deflected towards the duroplast selector shaft segments 38. As a result of this, at least one arc is always deflected towards the bundles of arc extinction plates 34 and another arc is deflected towards the Duroplast selector shaft segment 38 independently of the direction of current flow.

Figure 3:
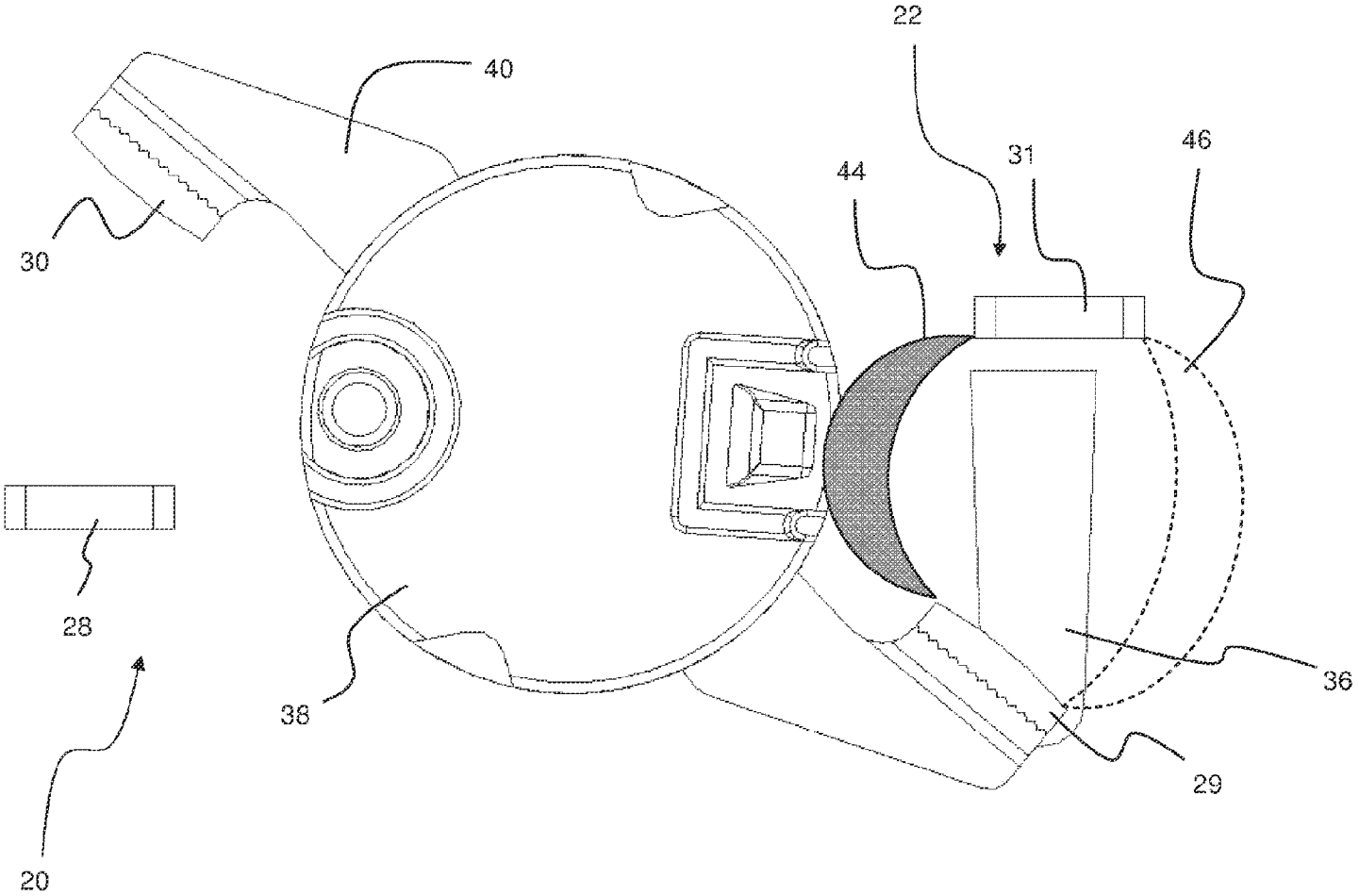
FIG. 3 shows the switch unit shown in FIG. 2 with permanent magnets for generating a magnetic field to deflect the arc between the switching contacts depending on the direction of current flow through the current paths of the switch unit.
Figure 4:
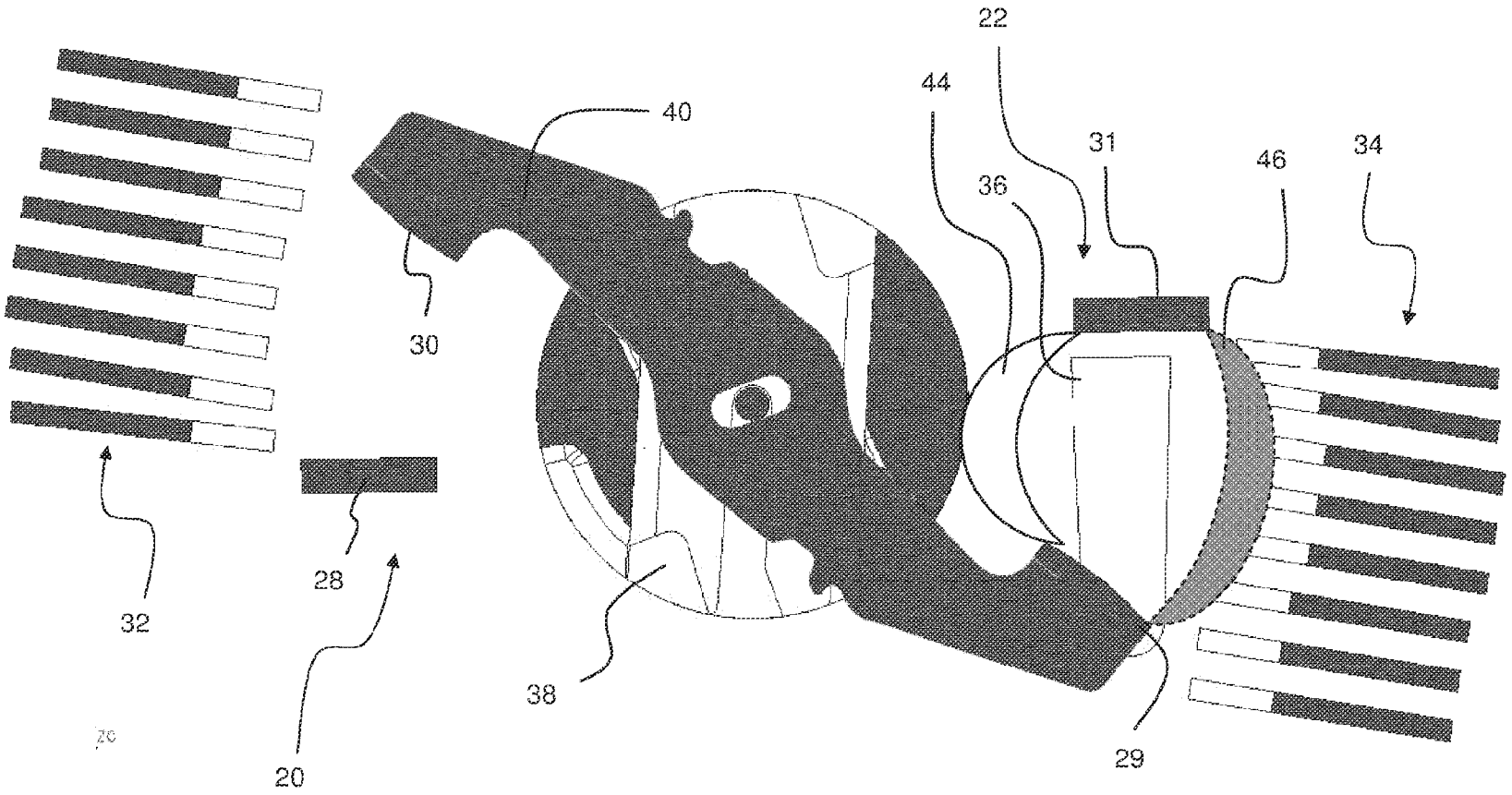
FIG. 4 shows the switch unit shown in FIG. 3 with extinction plates to extinguish an arc deflected towards the extinction plates

In the case of the switch disconnector 10 shown in FIG. 1, the arrangement of the permanent magnets is now selected such that when a direction of current flow through the current paths of the double interrupters 12, 14, 16 and 18 is in the direction of operating current flow, arcs at the first and second double interrupters 12 and 14 respectively are deflected by the permanent magnetic field into the respective extinction chamber and arcs at the two other double interrupters 16 and 18 are deflected in the opposite direction against the respective duroplast selector shaft segments of the double interrupters 16 and 18, as indicated by the bold arrows in FIG. 1. The deflection of arcs against the duroplast double interrupter selector shaft segment that rotates when the double interrupter is opened into the off position causes an extension and simultaneous cooling of the arc without destroying surrounding components. This leads to the required increase in voltage and thus also to the extinction of small and critical currents in the case of high voltages. FIG. 3 is a side view of a double interrupter in which an arc 44 is deflected towards the duroplast selector shaft segment 38 due to the arrangement of permanent magnets 36 and an arc 46 is deflected in the opposite direction in the reverse direction of current flow. FIG. 4 is a side view of a double interrupter with bundles of arc extinction plates 32 and 34 and deflected arcs 44 and 46. It can be seen clearly how the arc 46 is directed into the bundle of arc extinction plates 34, by which is it cooled and interrupted. Analogously, the arc 44, which is deflected towards the duroplast selector shaft segment 38, is cooled such that its resistance increases, which leads to the breakdown of the arc 44.

If the direction of current flow reverses, for example if a fault occurs, i.e. the current flows through the current paths in the opposite direction to the specified direction of operating current flow, arcs occurring when the interruption surfaces are opened are deflected in the direction indicated by the bold dotted arrow in FIG. 1. In such a case, arcs at the double interrupters 16 and 18 are therefore deflected into the respective extinction chambers and arcs at the double interrupters 12 and 14 are deflected against the respective duroplast double interrupter selector shaft segment. The effect is the same as when the direction of current flow is the direction of operating current flow since the selector shaft segments of the double interrupters 12 and 14 now cause a cooling of the arcs which are deflected onto them and extended.

It is crucial for arc extinction that is independent of the current direction that at least two of the magnetic fields generated by the arrangements of permanent magnets 36 in the region of the interruption surfaces of the individual double interrupters bring about an opposite deflection of arcs.

In principle, the arrangement of the permanent magnets 36 can also be distributed otherwise in any given manner. The permanent magnet arrangements should simply be distributed as evenly as possible such that similar extinction conditions exist with reversible directions of current flows and the device therefore safely disconnects the flow of current independently of polarity.

The remaining 4 contact points corresponding to the first interruption surface 24 of the double interrupters 12, 14, 16 and 18 are configured without permanent magnets in the case of the disconnector switch 10 shown in FIG. 1 (since these are not absolutely necessary for the extinction of small, critical currents). This has the consequence that in the case of small currents, an arc stops at the contact points 28 and 30 due to the aforementioned magnetic interaction between the contact points that is too small, and is neither forced towards the bundle of arc extinction plates 32 nor against the duroplast selector shaft segment 38. In the case of the small, critical currents, almost the entire extinction work is thus undertaken by the contact points 29 and 31 of the second interruption surface 26, which are equipped with permanent magnets 36.

In the case of higher currents (approximately >50 A up to overload, for example 4 times the nominal current), as many extinction chambers as possible are required for arc extinction (high energy contents). Since in the case of such high currents, arcs occurring between the contacts 28 and 30 are forced, even without permanent magnets 36, by the electromagnetic interactions into the extinction chambers or the bundle of arc extinction plates 32, 6 extinction chambers (+2 arcs, which run against the selector shaft) are always available (irrespective of in which flow direction), which is sufficient to extinguish the arc.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B, and C" should be interpreted as one or more of a group of elements consisting of A, B, and C, and should not be interpreted as requiring at least one of each of the listed elements A, B, and C, regardless of whether A, B, and C are related as categories or otherwise. Moreover, the recitation of "A, B, and/or C" or "at least one of A, B, or C" should be interpreted as including any singular entity from the listed elements, e.g., A, any subset from the listed elements, e.g., A and B, or the entire list of elements A, B, and C.

LIST OF REFERENCE NUMERALS

10 Switch disconnector for direct current
12 First rotatory double interrupter
14 Second rotatory double interrupter
16 Third rotatory double interrupter
18 Fourth rotatory double interrupter
20 First current path
22 Second current path
24 First interruption surface
26 Second interruption surface
28 Fixed contact
29 Contact piece with movable contact
30 Contact piece with movable contact
31 Fixed contact
32 Bundle of arc extinction plates
34 Bundle of arc extinction plates
36 Permanent magnet
38 Duroplast selector shaft segment
40 Switch contact arm
42 Undeflected arc
44 Arc deflected towards duroplast selector shaft segment
46 Arc deflected towards the bundle of arc extinction plates

The invention claimed is:

1. A direct current switch for arc extinction independent of current direction, the direct current switch comprising:

a first rotatory double interrupter switch unit including a selector shaft and at least two current paths, each current path including an interruption surface, each interruption surface including at least two contacts;

an arc extinction device associated with one or more of the at least two current paths; and one or more magnetic field generation devices configured to generate a magnetic field at each of the interruption surfaces, each magnetic field generated at a respective interruption surface having field lines that run substantially transversely to the respective interruption surface, wherein, for a predetermined direction of current flow, deflection forces caused by the magnetic field generated at each of the interruption surfaces act to deflect arcs extending in a longitudinal direction of each of the interruption surfaces such that at least one are is deflected towards the arc extinction device and a further are is deflected onto the selector shaft.

2. The direct current switch of claim 1, wherein the one or more magnetic field generation devices configured to generate a magnetic field at each of the interruption surfaces comprise a first magnetic field generation device disposed adjacent to a first of the at least two current paths and a second magnetic field generation device disposed adjacent to a second of the at least two current paths.

3. The direct current switch of claim 2, wherein, in the case of half of the interruption surfaces, the deflection forces of the magnetic fields generated by the one or more magnetic field generation devices act on arcs extending in the longitudinal direction of the respective half of the interruption surfaces such that, at the predetermined direction of current flow through the current paths, the arcs are deflected towards the arc extinction device, and wherein, in the case of the remaining half of the interruption surfaces, deflection forces of the magnetic fields generated by the one or more magnetic field generation devices act on arcs which extend in the longitudinal direction of the respective half of the interruption surfaces such that, at the predetermined direction of current flow through the current paths, the arcs are deflected towards the selector shaft.

4. The direct current switch of claim 2, wherein the first rotatory double interrupter switch unit includes a material configured to bring about a cooling of the arc.

5. The direct current switch of claim 3, wherein the first rotatory double interrupter switch unit includes a material configured to bring about a cooling of the arc.

6. The direct current switch of claim 1, wherein the rotatory double interrupter switch unit includes a material configured to bring about a cooling of the arc.

7. The direct current switch of claim 1, wherein the one or more magnetic field generation devices includes at least one permanent magnet.

8. The direct current switch of claim 1, wherein the selector shaft segment of the first rotatory double interrupter switch unit includes a material configured to bring about a cooling of the arc.

9. The direct current switch of claim 1, wherein the first rotatory double interrupter switch units includes a duroplast material.

10. The direct current switch of claim 1, wherein the selector shaft segment of the first rotatory double interrupter switch units includes a duroplast material.

11. The direct current switch of claim 1, wherein housing parts of the switch unit include a material configured to bring about a cooling of the arc.

12. The direct current switch of claim 1, wherein housing parts of the first rotatory double interrupter switch unit include a duroplast material.

13. The direct current switch of claim 1, further comprising:

a second rotatory double interrupter switch unit including a selector shaft and at least two current paths, each current path including an interruption surface, each interruption surface including at least two contacts;

a second arc extinction device associated with one or more of the at least two current paths of the second rotator double interrupter switch unit; and one or more magnetic field generation devices configured to generate a magnetic field at each of the interruption surfaces of the second rotator double interrupter switch unit, each magnetic field generated at a respective interruption surface having field lines that run substantially transversely to the respective interruption surface, wherein the second rotator double interrupter switch unit is interconnected with the first rotator double interrupter switch unit.

14. The direct current switch of claim 13, wherein, in the case of the first rotatory double interrupter switch unit, the deflection forces of the magnetic fields generated by the magnetic field generation devices act on arcs extending in the longitudinal direction of the respective interruption surface such that, at the predetermined direction of current flow through the current paths, the arcs are deflected towards the arc extinction device, and wherein, in the case of the second first rotatory double interrupter switch unit, deflection forces of the magnetic fields generated by the magnetic field generation devices act on arcs which extend in the longitudinal direction of the respective interruption surface such that, at the predetermined direction of current flow through the current paths, the arcs are deflected towards parts of the switch units which facilitate extinction of the arcs.

15. The direct current switch of claim 13, configured to be a four-phase alternating current switch, which is configured to switch direct currents by way of interconnection of the individual first and second rotatory double interrupter switch units.

* * * * *